US005900597A

United States Patent [19]

Fernkas

[11] Patent Number: 5,900,597

[45] Date of Patent: May 4, 1999

[54] ELEVATOR CONTROLLER/SOLID STATE DRIVE INTERFACE

[76] Inventor: Joseph Clifford Fernkas, 3901 Schroeder Ave., Perry Hall, Md. 21128

[21] Appl. No.: 09/044,343

[22] Filed: Mar. 19, 1998

[51] Int. Cl.[6] ..... B66B 1/28

[52] U.S. Cl. ..... 187/297; 187/293

[58] Field of Search ..... 187/297, 289, 187/277, 293, 247

[56] References Cited

U.S. PATENT DOCUMENTS

| | | | |
|---|---|---|---|
| 1,962,341 | 6/1934 | Eames | 172/152 |
| 2,096,473 | 10/1937 | Stevens | 172/152 |
| 2,224,718 | 12/1940 | Bouton et al. | 187/29 |
| 2,278,120 | 3/1942 | Schwarz | 172/152 |
| 2,359,092 | 9/1944 | Eames et al. | 187/29 |
| 2,361,170 | 10/1944 | Bouton | 187/29 |
| 2,363,302 | 11/1944 | Eames | 187/29 |
| 2,403,125 | 7/1946 | Santini et al. | 187/29 |
| 2,669,324 | 2/1954 | Lund | 187/29 |
| 2,746,567 | 5/1956 | Güttinger et al. | 187/29 |
| 3,200,321 | 8/1965 | Rosenstein | 321/3 |
| 4,034,856 | 7/1977 | Wehrli, III et al. | 187/29 |
| 4,258,829 | 3/1981 | Johnson | 187/293 |
| 4,307,793 | 12/1981 | Caputo | 187/297 |
| 4,340,131 | 7/1982 | Eriksson | 187/29 |
| 4,457,404 | 7/1984 | Husson et al. | 187/29 |
| 4,582,174 | 4/1986 | Kvartin et al. | 187/29 |
| 4,671,390 | 6/1987 | Stanyard et al. | 187/120 |
| 4,721,188 | 1/1988 | Araki et al. | 187/119 |
| 5,497,289 | 3/1996 | Sugishima et al. | 361/709 |
| 5,617,307 | 4/1997 | Guigueno | 363/37 |

*Primary Examiner*—Robert E. Nappi
*Attorney, Agent, or Firm*—Leonard Bloom

[57] ABSTRACT

An elevator controller/solid state drive interface allows an existing relay logic passenger elevator controller to be retrofitted with either a DC or AC solid state drive replacing the motor generator set for DC hoist motors or the two-speed starter in AC systems. This interface can also allow systems utilizing a motor generator set and DC hoist motor to be retrofitted with an AC solid state drive and AC hoist motor while retaining the existing controller. The controller/solid state drive interface includes selectable dropping resistors to adapt to various control VDC from an existing elevator controller to a 24 VDC relay bank. An electrical circuit coupled to the relay bank (containing additional relays and timers) provides control signals to the solid state drive, which in turn provides the drive power to the hoist motor. Sequencing of specific control signals and creation of the functions necessary for proper operation of the solid state drive are provided within the controller/solid state drive interface.

10 Claims, 8 Drawing Sheets

ELEVATOR CONTROLLER/SOLID STATE DRIVE INTERFACE

BACKGROUND OF THE INVENTION

1. Field of the Invention

This invention pertains to passenger elevators generally, and more specifically to an electrical control circuit for powering an elevator hoist motor.

2. Description of the Related Art

In cities around the world, real estate has become more valuable with increases in population density. To best utilize precious land area, architects and engineers have designed and erected buildings of ever increasing heights. These tall buildings are not new, some having existed for more than a century. In order to provide reasonable access to the upper floors of these buildings, elevators have been provided as a matter of course. Hoist motors provide the actual raising and lowering forces applied to the elevator car, while motor-generators convert A/C power from an electrical supply line to DC and are used as part of the control of both speed and direction of the hoist motor. As one will recognize immediately, electronic circuits capable of controlling the large hoist motors used with elevators were not available to building designers until recently. Instead, large switch banks and massive motor-generator sets provided the necessary interface to a hoist motor.

Many of the tall buildings were and continue to be constructed with long-life materials such as reinforced concrete and steel. As a result, these buildings have outlasted the useful life of the motor-generator sets. With the advent of more advanced and lower cost electronic devices, repair or replacement of motor-generator sets with identical motor-generators is no longer preferred. A modern Solid State Drive (abbreviated SSD) performs the basic functions of the older motor-generators while offering added advantages. For example, the SSD may be used to very precisely control parameters such as accelaration and deceleration of the elevator car. Compensation for variable hoist motor parameters such as winding impedance and field strength may occur instantaneously, or, in some designs, may not be required at all.

Unfortunately, replacement of the motor-generator set has, in the prior art, also necessitated replacement of the entire elevator control system. Replacement of the existing controls which are used in part to drive motor-generator sets is very costly and unduly burdensome to building owners.

SUMMARY OF THE INVENTION

The present invention alleviates the need to replace an existing elevator control to retrofit an existing elevator system with a SSD. In a first manifestation of the invention, an elevator controller/SSD interface interfaces between an elevator control and a solid-state motor drive. The interface provides conversion of signals from the elevator controller and provides control functions to the solid state drive not available from the existing elevator control. The interface also provides sequencing control during start-up and shut down of the solid-state motor drive, thereby enabling the solid state motor drive to successfully drive a hoist motor.

In a second manifestation, an elevator hoist motor control system comprises an elevator control having a first output indicative of a demand for upward or downward motion, a second output indicative of a demand for a predetermined motion speed, and additional outputs each indicative of a different and unique direction or preset speed; a solid-state drive having as control inputs an enable signal line, a forward signal line, a reverse signal line, three speed switch signal lines or analog speed reference lines; a field enable signal line and an acceleration-deceleration curve selection signal line; and a means for converting outputs to inputs and sequencing the enabling input with the closing and opening of the armature contactor.

In a third manifestation, a retrofittable elevator controller/SSD interface and solid-state drive is adapted for retrofitting existing elevator control systems equipped with motor-generator sets and replaces the motor-generator set without replacing the existing elevator controller. This manifestation comprises a relay bank switched by said existing elevator controller, a sequencing means including a first enabling delay timer responsive to demand for motion from the elevator control, a second disabling delay timer responsive to the first enabling delay timer and producing as an output thereof a delayed enabling and a delayed disabling signal subsequently coupled to said solid-state drive; and a speed logic converter for creating composite speed signals or an analog VDC signal from individual speed signals provided by the existing elevator controller.

OBJECTS OF THE INVENTION

A primary object of the present invention is to provide a working interface between relay logic control systems and a modern SSD. A further object of the present invention is to use as much of the output from the older control systems as possible, while enabling additional functionality necessary for proper operation of the SSD. Another object of the invention is to provide an interface which is capable of functioning properly with a variety of existing elevator controllers. These and other objects of the invention are achieved in the preferred embodiment, which offers significant advantage over prior art SSD control circuitry.

DESCRIPTION OF THE PREFERRED EMBODIMENT

Figure 1:
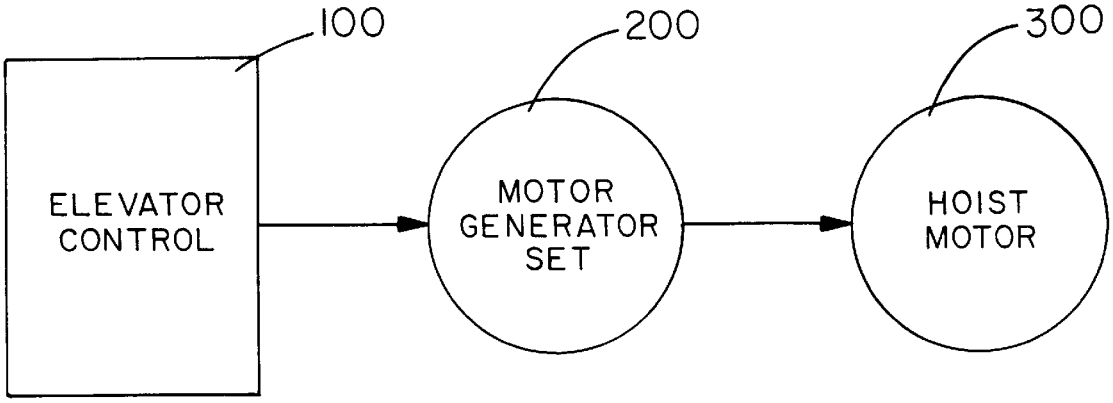
FIG. 1 PRIOR ART
FIG. 1 illustrates a prior art electrical control system for an elevator car by simplified block diagram.

In prior art control systems such as that shown in FIG. 1, an electro-mechanical control system 100 provides power and control to a motor-generator set 200, which in turn provides the necessary drive power for hoist motor 300. As is well-known, elevator control 100 will typically include a number of relays and control voltages conventional in the art for such diverse functions as "up", "down", various speed settings, and so forth to be discussed in more detail herein below. These relays add or subtract resistors from the shunt field circuit of the generator and additionally control the polarity applied thereto, to produce predetermined polarity and voltage at the output of the motor-generator set 200 dependent upon the particular combination of relays. The output from motor-generator set 200 is then used to directly power hoist motor 300.

Figure 2:
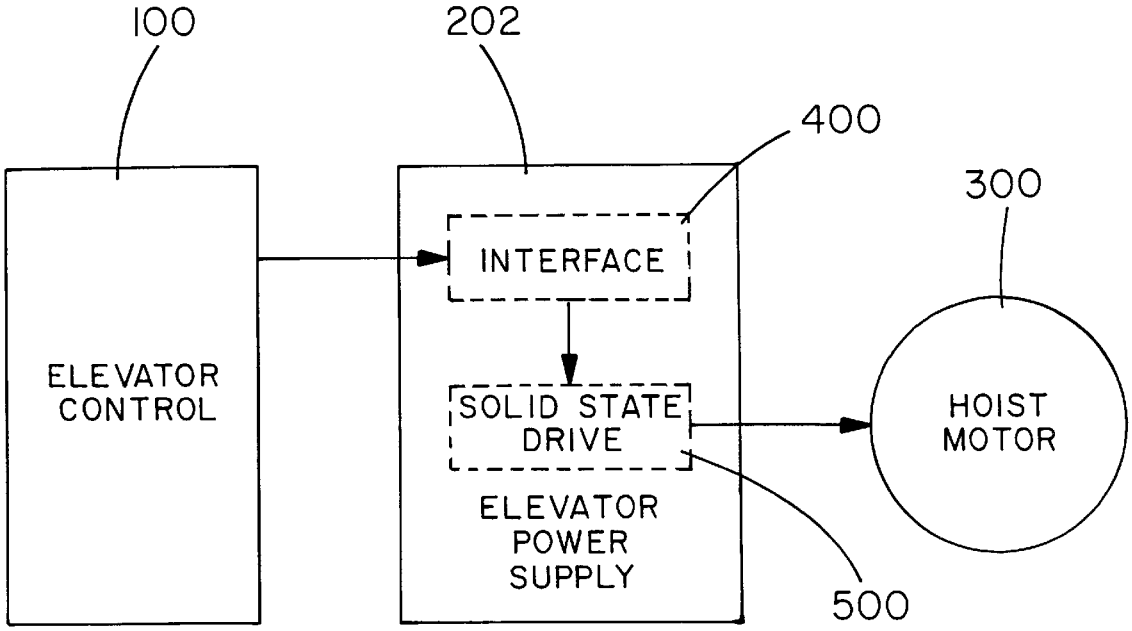
FIG. 2 illustrates by simplified block diagram a preferred embodiment interface of the present invention interconnected with both a prior electro-mechanical control and a SSD.

To replace a motor-generator set 200 with a commercially available SSD 500 shown in FIG. 2 has previously required the replacement of both motor-generator set 200 and elevator controller 100. In a preferred embodiment of the present invention, motor-generator set 200 is replaced by interface 400 and SSD 500, the combination which is identified as elevator power supply 202. As is apparent from FIGS. 1 and 2, the present invention preserves elevator controller 100 and yet provides benefits that are obtainable only through a solid-state drive such as with SSD 500. In this way, a building owner may continue to obtain the benefit of existing elevator controller 100 and not incur the additional expense which was, prior to the present invention, necessary to incorporate SSD 500. Additionally, the present invention is not limited to one particular type of SSD, and may therefore be used with a variety of suitable devices. In the preferred embodiment, the SSD is a model #Series 20H available from Baldor Electric Co. located in Ft. Smith, Ariz., USA.

Figure 3:
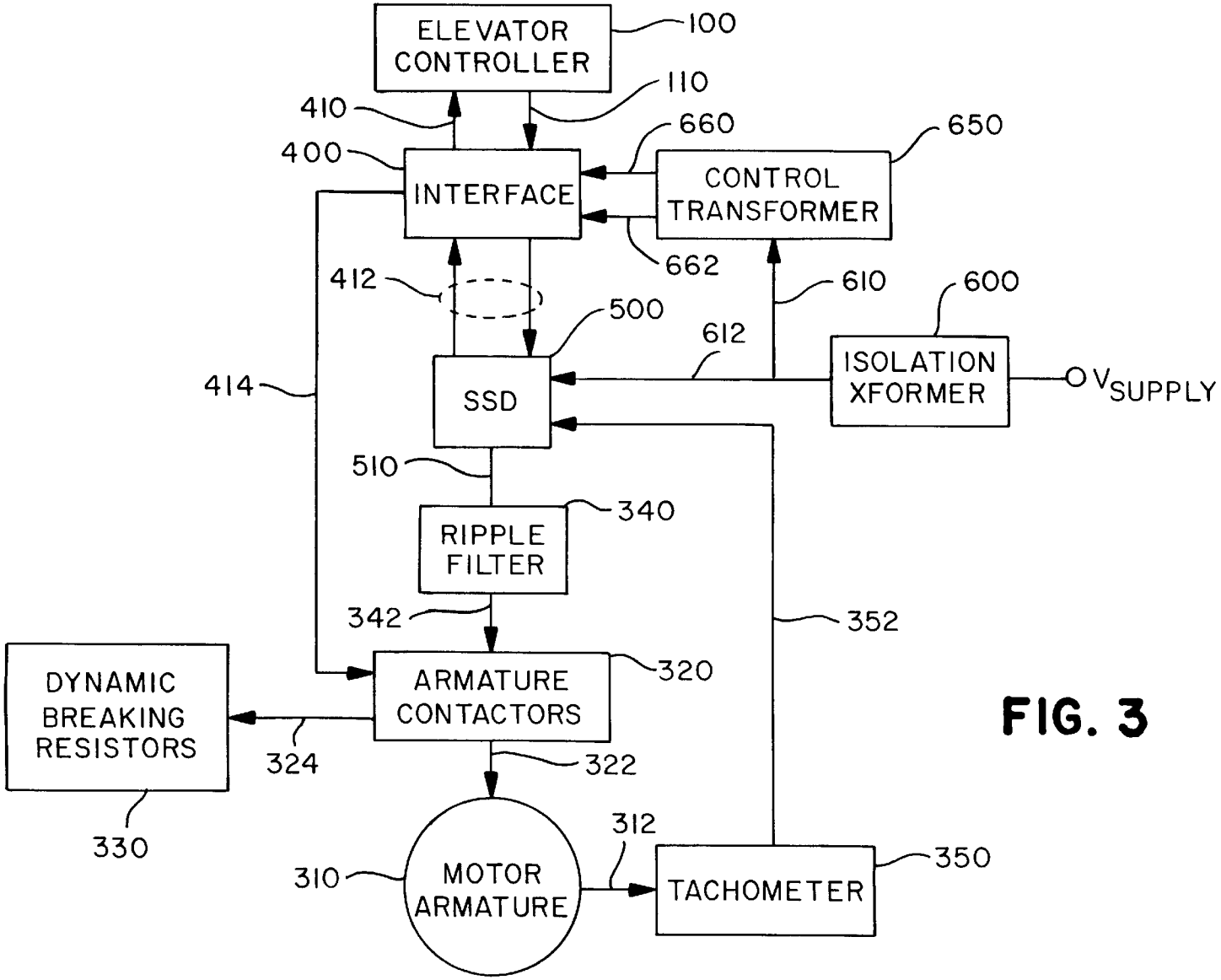
FIG. 3 illustrates by a more detailed block diagram the interrelationship of the present invention to existing elevator control system components.

FIG. 3 illustrates in much greater detail the actual interconnection between the preferred embodiment and prior art components. Elevator controller 100 is accessed at the control relays to obtain directional and speed commands, which are then carried through signal lines 110 to interface 400. In addition, interface 400 provides a brake interlock back to elevator control 100 through signal line 410.

Power to drive SSD 500 is derived from V supply, which may be isolated, filtered or transformed by transformer 600. Transformer 600 delivers power directly to SSD 500 through line 612. In addition, transformer 600 delivers power to interface 400 through line 610 and control transformer 650 and 24 VDC power supply. Control transformer 650 provides 120 VAC through line 660 and 24 VDC power supply line 662, both to interface 400.

Control of SSD 500 by interface 400 is managed through signal lines 412 generally, which include a variety of control signals to be discussed in greater detail herein below. Additional information is passed from SSD 500 back to interface 400 through these lines as well.

SSD 500 provides the high output power required to energize motor armature 310 through output 510. Output 510 may optionally be filtered through ripple filter 340 to minimize the amount of high frequency voltage fluctuation to motor armature 310. It will be appreciated by those skilled in the art that ripple filter 340 may not be necessary for some applications.

Motor armature drive power is further transmitted through line 342 to armature contactor 320, which must be closed to actually energize motor armature 310. From contactor 320, drive power is carried by line 322 into motor armature 310. Interface 400 controls the operation of armature contactor 320 through signal line 414, as will be discussed herein below. Additionally, armature contactors 320 interact with dynamic braking resistors 330 through signal line 324, as will also be discussed in greater detail herein below. Tachometer 350 measures the rotation of armature 310 and transmits a signal indicating speed and direction of rotation through line 352 to SSD 500.

As will be apparent to one of ordinary skill, the functions of each diagram within FIG. 3 may be implemented as separate entities as shown, or several of these functions may be integrated directly into one of the illustrated components to yield the same desired function without departing from the true scope of the invention. For example, the functionality provided by control transformer 650 may be incorporated directly into the circuitry of interface 400 or, alternatively, the circuitry of interface 400 may be designed so as to avoid or alleviate the need for the separate control voltages provided along lines 660 and 662. Such changes, while not preferred, would be within the scope of one of ordinary skill when considered in conjunction with the balance of this disclosure.

Figure 4:
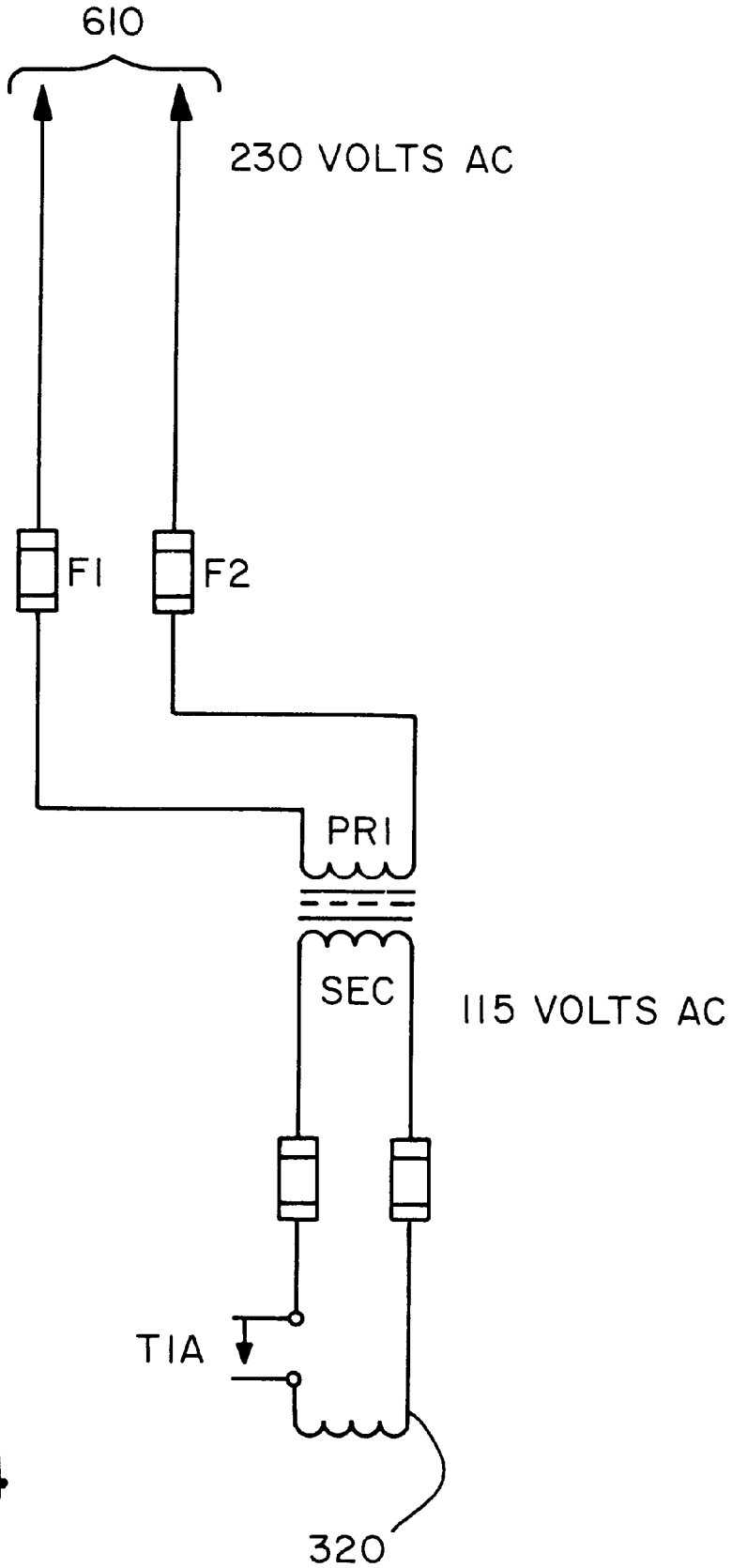
FIG. 4 illustrates by schematic diagram the wiring of the control transformer of the preferred embodiment.

FIG. 4 illustrates by schematic diagram the actual control wiring of the armature contactor 320's coil.

Figure 5:
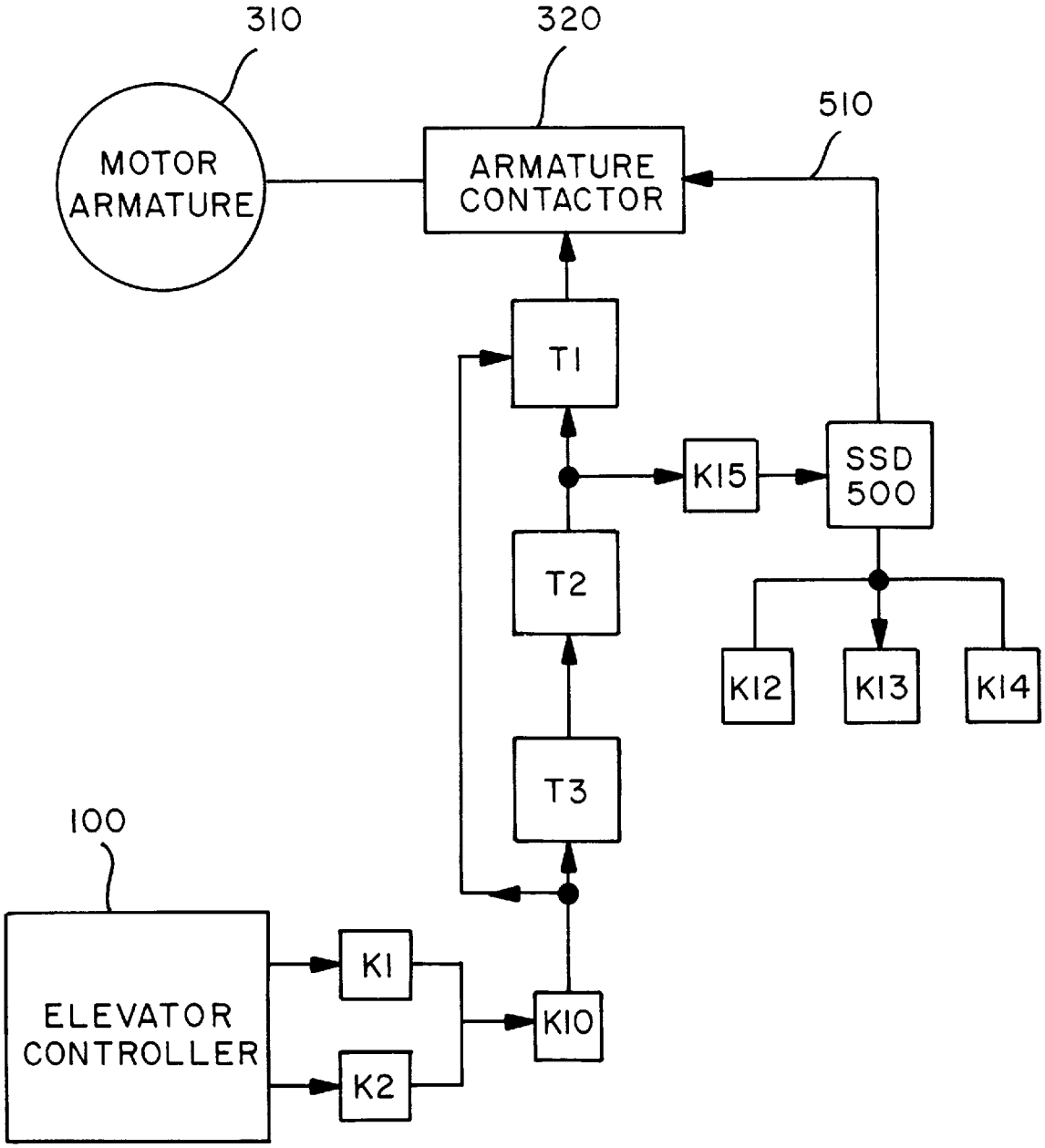
FIG. 5 is a block diagram illustrating the preferred embodiment of the interface.

FIG. 5 illustrates (by block diagram) the relays and timers of interface 400. Enable relay K10 is actuated by either "up" relay K1 or "down" relay K2, being energized by elevator controller 100. Relay switch 10A actuates armature "delay off" timer T1, immediately energizing armature contactor 320 connecting the output of SSD 500 to motor armature 310. Relay switch 10A also simultaneously actuates "enable delay on" timer T3. Upon "timing out" T3 energizes "enable delay off" timer T2. T2 immediately energizes "SSD enable" relay K15 sending delayed enabling signal to SSD 500. The delayed signal allows armature contactor 320 to be energized prior to SSD 500 being enabled.

When stopping, direction relay K1 or K2 drops out de-energizing K10 which in turn de-energizes T3. SSD remains enabled by T2, delay off timer, allowing the car enough time to come to a stop and for the brake to set. When T2 times out, relay switch T2A opens disabling the SSD and initiating the delay off timing cycle for T1. Once T1 times out, relay switch T3-A opens and removes power from the holding coil of armature contactor 320. Armature contactor 320 de-energizes and motor armature leads are connected to the dynamic braking resistors. The three drive output auxiliary relay coils K12, K13 and K14 are energized by relay switches provided from SSD 500.

Figure 6:
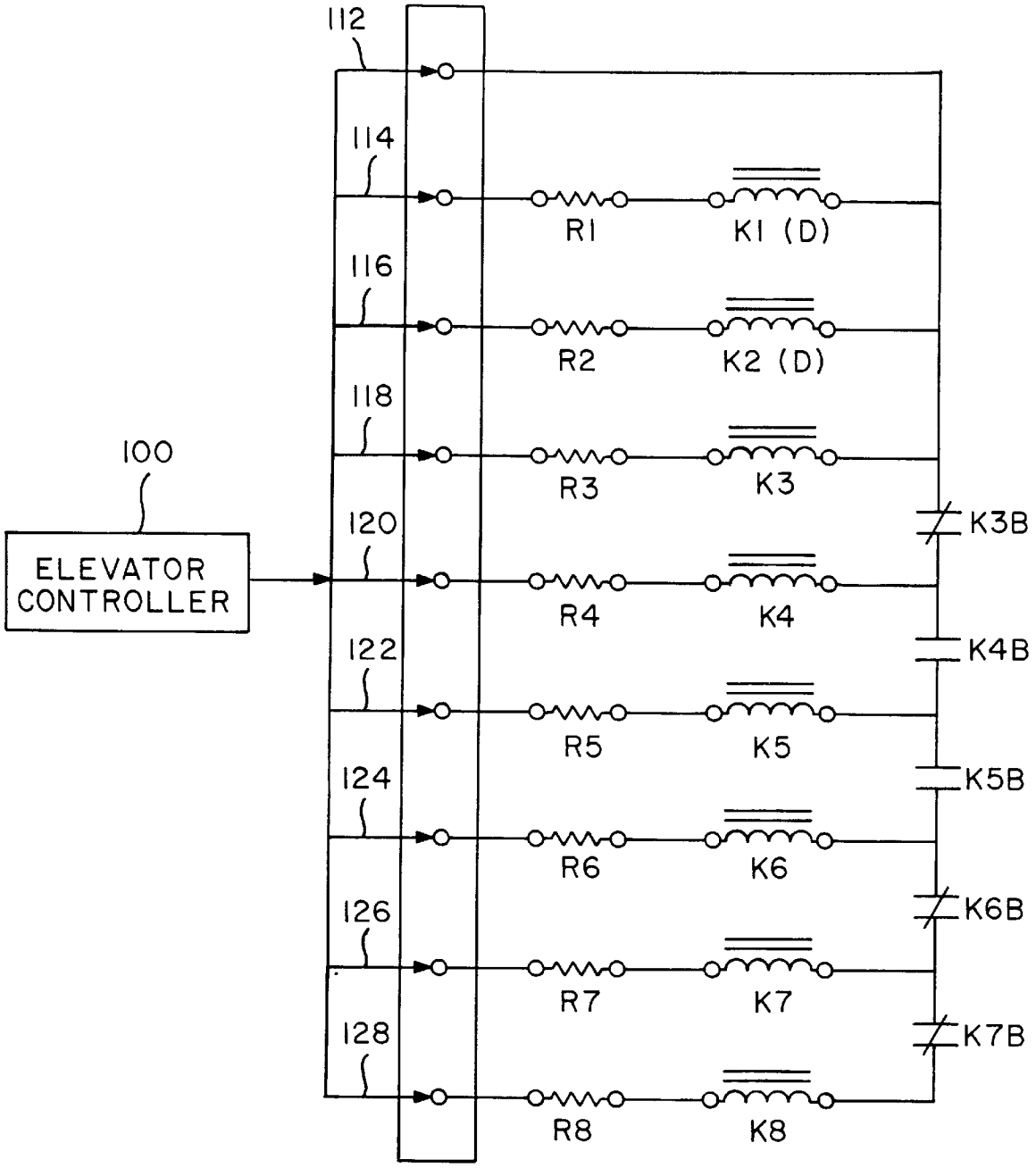
FIG. 6 illustrates schematically a relay bank of the preferred embodiment which is directly interconnected with a prior art elevator control, including both a 24 VDC relay bank and inner changeable voltage dropping resistors.

FIG. 6 illustrates the interconnection between interface 400 and elevator control 100. As aforementioned, the preferred embodiment interface 400 will most preferably be able to interface with a variety of elevator controllers. Most of the prior art elevator controller relays have either 120 VDC or 240 VDC coils. In the preferred embodiment, interface 400, 24 VDC relays are driven by elevator control 100; a dropping resistor sized for the input voltage reduces the input voltage from 240 VDC or 120 VDC to 24 volts.

As will be apparent to those skilled in the art, relay coils K4–K8 are interlocked with the previous relays normally closed switch, to allow only one "speed select relay" K3–K8, to be energized at a time.

Figure 7:
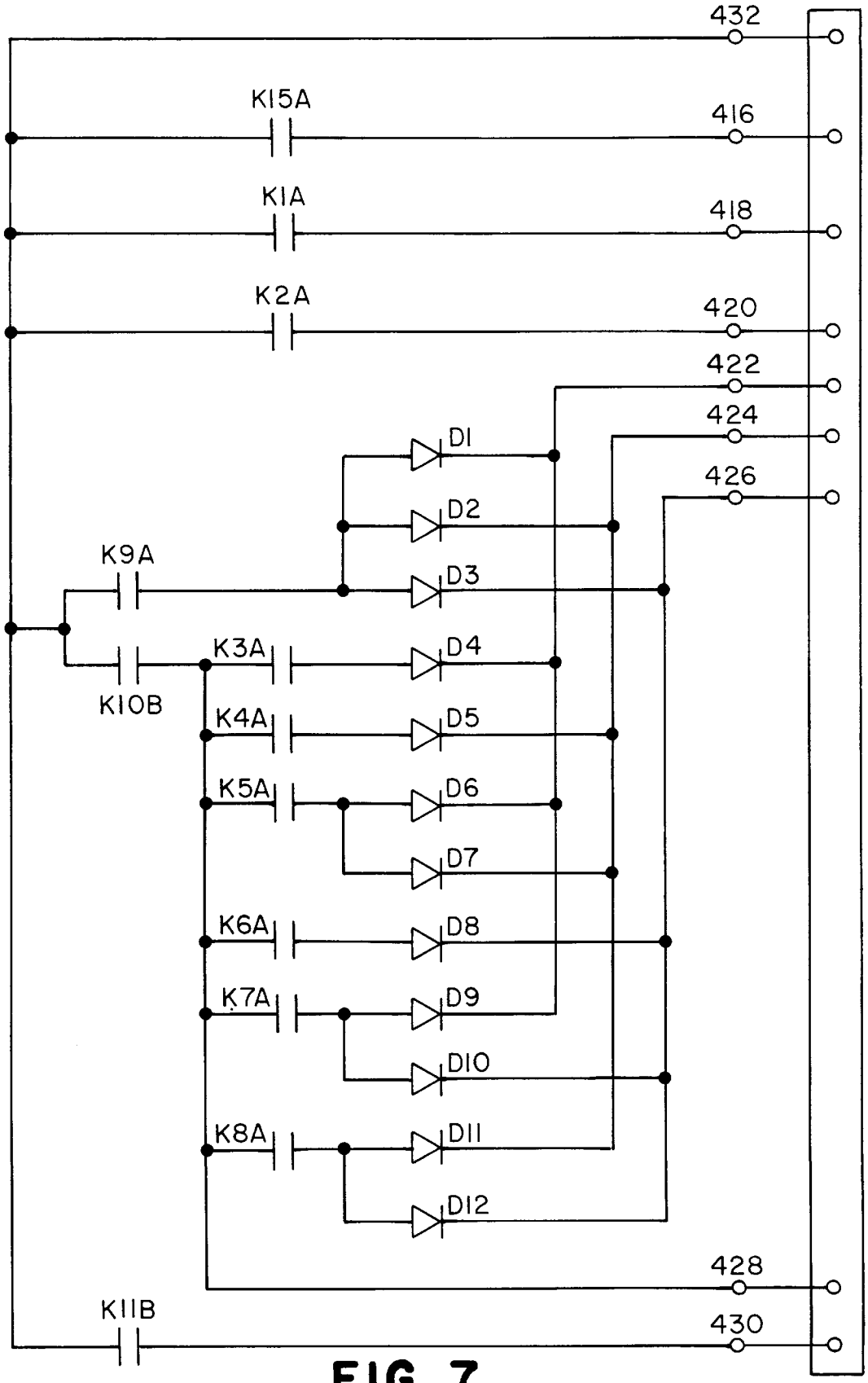
FIGS. 7 and 8 illustrate schematically a bank of relay switches of the preferred embodiment used to output control signals to the prior art SSD.

FIG. 7 illustrates the various output relay combinations necessary to control SSD 500, which are provided by interface 400 through multi-wire control cable 412. Signal line 416 is the enable output provided through relay switch K15A controller by the output of T2. Signal line 418 is the closed=forward direction control output of relay switch K1A. Signal line 420 is the closed=reverse direction control output of relay switch K2A. There are three speed output signals provided through lines 422, 424 and 426; various open and closed combinations indicate a preset speed. The "input common" from SSD 500, provided through signal line 432 is connected by K10B to the "common" of "speed select" switches K3A–K8A. The normally open sides of switches K3A–K8A are connected to one or more of speed select lines 422, 424 and 426. Through this arrangement of switches, signals indicative of a preset speed sent form prior art elevator controller 100 are converted to SSD speed input signals. Signal line 428 is the closed=field enable output of relay switch K10B. 430 is the "S curve" select output of relay switch K11B.

Figure 8:
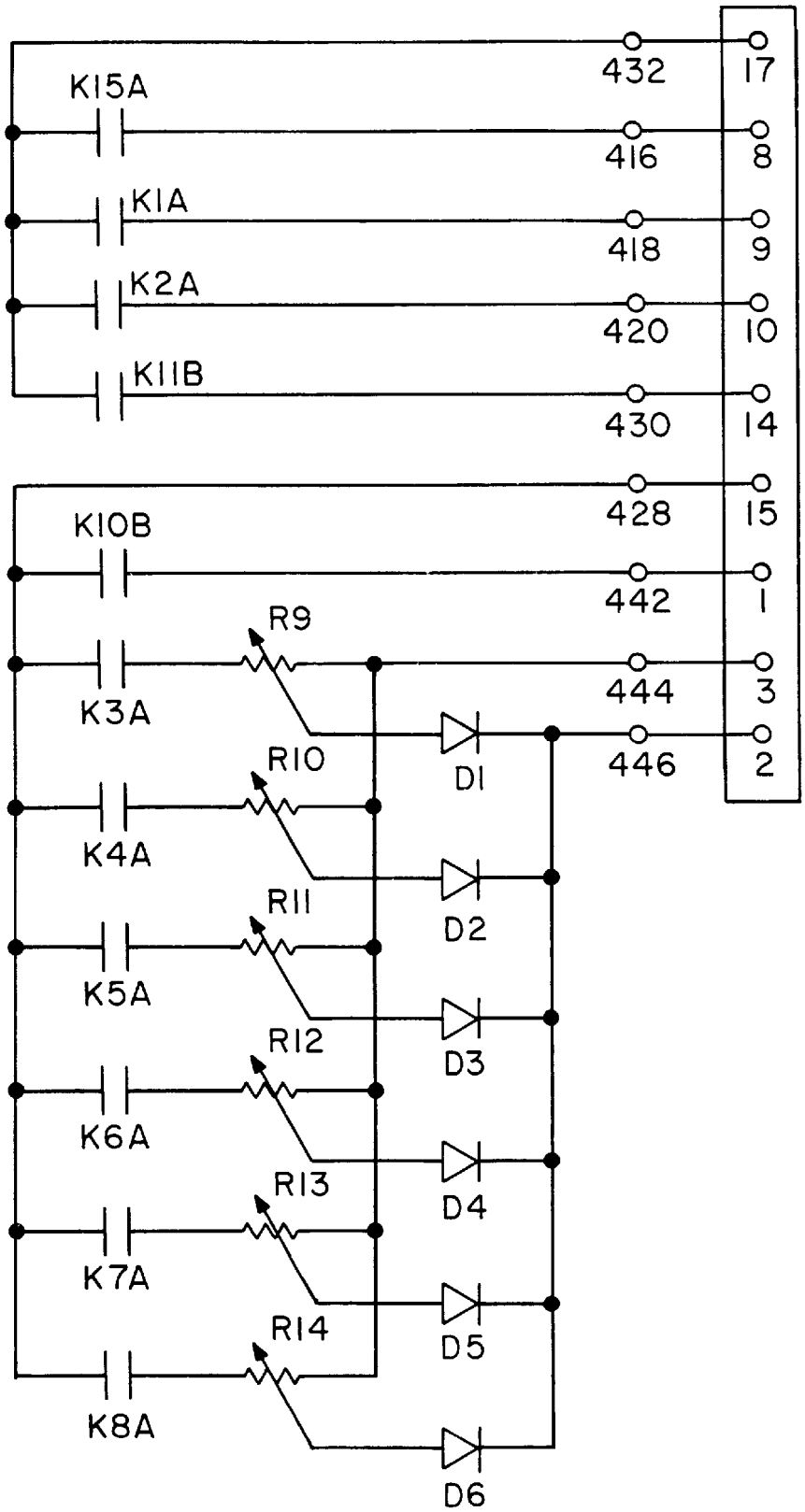

FIG. 8 illustrates a variation of FIG. 7 where preset speed selections are being provided to SSD 500 in the form of an analog DC voltage through signal line 446. Variable resistors R9–R14 are connected to SSD 500's internal power supply through signal lines 442 and 444.

Figure 9:
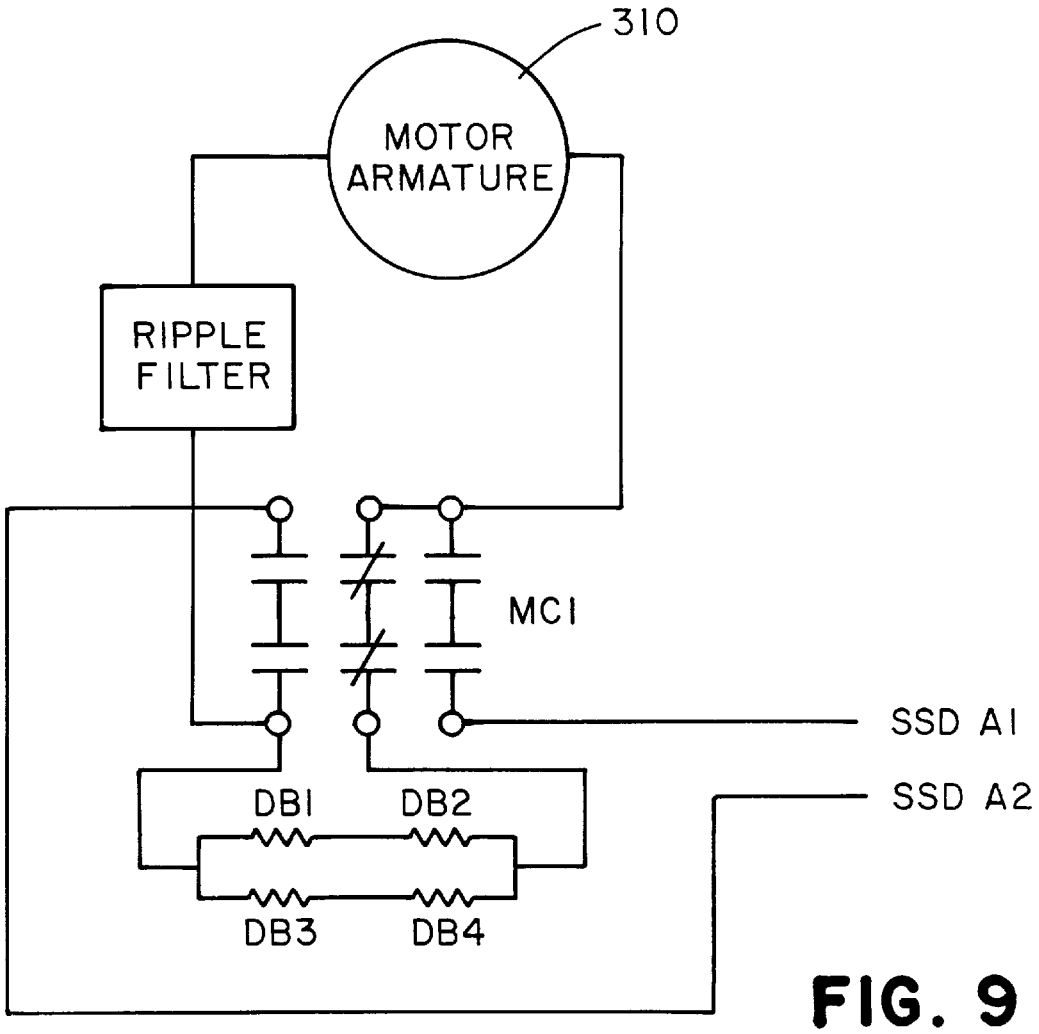
FIG. 9 illustrates schematically a hoist motor armature together with directly associated contactor switches.

FIG. 9 illustrates three contacts of armature contactor 320 of FIG. 3 which directly controls motor armature 310; power is supplied to these contactors through power line 342. In armature contactor 320's normal state, dynamic braking resistors D1–D4 (which are illustrated as block 330 in FIG. 3) are put into the armature circuit. When energized by the output of switch A of T1, the armature contactor connects armature 310 to output of SSD 500. Armature contactor, 320's normally open auxiliary contact is used to interlock power to relay coil K12, brake interlock relay; this control is transferred to elevator controller 100 through brake interlock relay switches K12A and K12B which are connected to elevator controller 100 through line 410.

In operation, interface 400 sequences relays in a particular order to properly control SSD 500. The starting sequence begins with "up" relay K-1 or down relay K2, shown in FIG. 7, being actuated by a signal from elevator controller 100. Either relay will actuate "enable" relay K10. Relay coil K10 switches two different switches K10A and K10B. K10A actuates armature delay off timer T1 visible in FIG. 6. T1 immediately energizes armature contactor 320, removing dynamic braking resistors DB1–DB4 (visible in FIG. 9) from the armature circuit and connecting motor armature 310 to the output of SSD 500. Simultaneously, switch K10A also actuates "enable" delay on timer" T3. Timer T3 "times out" allowing enough time for T1 to energize armature contactor 310, then energizes enable delay off timer T2. T2 immediately energizes relay K15 which sends an enabling signal to SSD 500.

Figure 10:
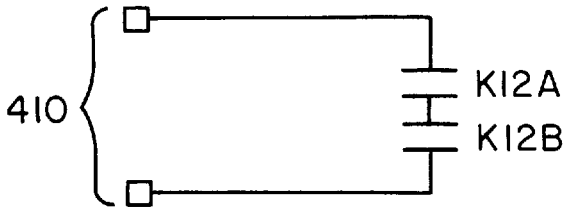
FIG. 10 is a schematic diagram illustrating the brake interlock relay switch which is used to de-energize the brake release circuit upon drive failure.

It is very important for the armature contactor to be closed prior to SSD500 being enabled or else SSD500 will immediately trip out on a fault condition. By delaying sending an enabling signal to SSD 500 until after contactors 320 are closed, SSD500 will sense torque on the motor armature 310; this indicates to SSD500 that the armature circuit is completed. As an additional safety feature, SSD500 checks to ensure that V supply is present, no faults exist, and that an enable signal is provided through signal line 416—all before energizing brake interlock K12. Once SSD500 energizes brake interlock K12, and normally open auxiliary contact of armature contactor 320 (shown in FIG. 10) is closed, power sent from elevator controller 100 is allowed to energize the brake release on the hoist motor through signal line 410.

Once SSD 500 is operative, the particular speed selector relay switch K3A–K8A (shown in FIG. 8) is closed which determines the speed selected by SSD500. These switches are closed as a result of control signals transmitted from controller 100 through signal lines 110 to each of the speed select relay coils K3–K8, each shown in FIG. 7.

When the elevator car should be stopped, elevator control 100 de-energizes the up relay coil K1 or the down relay coil K2 of FIG. 7 that began the motion. This will in turn de-energize relay coils K10 and K11. However, the enable-off delay timer T2 continues to keep relay switch T2-A closed long enough to allow SSD500 to bring the elevator car to a stop and for elevator controller 100 to apply the holding brake. When timer T2 times out and de-energizes, the relay on timer T2 opens, de-energizing K-15 and disabling SSD 500. However, even though power is no longer being applied to armature 310 from SSD 500, armature contactor off delay T-1 delays the opening of contactors 320 by maintaining power to the coil of armature contactor 320. This added delay allows the voltage and current through contactor 320 to settle and preferrably drop to zero.

Where the specific constructions of components or systems have not been outlined, it will be understood that known devices which perform the intended functions are presumed to be included herein. In many instances, both electro-mechanical and electronic devices are capable of performing many of the functions outlined herein. More specifically, while the preferred embodiment describes relay coils and relay switches as though they are constructed from electro-mechanical components, it will be apparent that electronic equivalents are known, available, and may be suited for use herein as may be deemed desirable by a particular designer. Furthermore, the delay functions performed by T1, T2 and T3 may similarity be achieved with either electro-mechanical or electronic equivalents.

While the foregoing details what is felt to be the preferred embodiment of the invention, no material limitations to the scope of the claimed invention are intended. Further features and design alternatives that would be obvious to one of ordinary skill in the art are considered to be incorporated herein. The scope of the invention is set forth and particularly described in the claims hereinbelow.

I claim:

1. An elevator controller/SSD interface, which interfaces an elevator controller and a solid-state motor drive, wherein the elevator controller/SSD interface provides conversion of signal lines to provide control functions not available from said elevator controller and provides sequencing control during start-up and shut down of said solid-state motor drive, thereby enabling said solid-state motor drive to successfully drive a hoist motor with control logic from said elevator controller transmitted through said elevator controller/SSD interface, comprising:

a first relay actuated in response to an output from said elevator control indicative of a request for forward or reverse motion of a hoist motor, and a second relay actuated in response to an output from said elevator control indicative of a request for a predetermined speed of said hoist motor;

electrical connecting means for electrically connecting said solid-state drive to said hoist motor responsive to said first relay;

a first timing means actuated in response to said first relay for transmitting a delayed enabling signal to said solid-state motor drive and for transmitting a delayed disabling signal to said solid-state motor drive when said first relay is no longer actuated;

a second timing means actuated in response to said first relay for transmitting an immediate connect signal to said electrical connecting means and responsive to said first timing means for transmitting a delayed disconnect signal to said electrical connecting means which is delayed more than said delayed disabling signal, wherein said electrical connecting means electrically connects said solid-state drive to said hoist motor prior to said first timing means transmitting said delayed enabling signal to said solid-state motor drive, and wherein said electrical connecting means electrically disconnects said solid-state drive from said hoist motor after said first timing means transmits said delayed disabling signal to said solid-state motor drive.

2. The elevator controller/SSD interface of claim 1, further including a third relay actuated in response to an output from said elevator control indicative of a request for a second preset speed.

3. The elevator power supply interface of claim 2, further comprising a fourth relay actuated in response to an output from said elevator control and indicative of a request for a third preset speed, said second relay and said third relay being interconnected to share speed control signal lines between said interface and said solid-state motor drive.

4. The elevator controller/SSD interface of claim 1, wherein said first timing means further comprises a first timer having as an input a signal representative of an actuated state of said first relay and responsive thereto for generating a first output delayed in time from when said first relay is actuated, and a second output without delay time from when said first relay is no longer actuated.

5. The elevator power supply interface of claim 4, wherein said first timing means further comprises a second timer having as an input said output of said first timer and generating an output therefrom which takes a first state immediately with said first output of said first timer and which takes a second state delayed from said output of said first timer, said output of said second timer comprising said delayed enabling signal of said first timing means and comprising said delayed disabling signal of said second timing means.

6. The elevator power supply interface of claim 1, wherein said electrical connecting means comprises electrical contactors.

7. The elevator power supply interface of claim 3, further comprising fifth, sixth and seventh relays, respectively, actuated in response to an output from said elevator control and indicative of a request for a fourth, fifth and sixth preset speed; wherein said second, third, fourth, fifth, sixth and seventh relays are all interconnected to share relay coil negative ground with said elevator control.

8. An elevator hoist motor control system comprising in combination:

an elevator control having a first output indicative of a demand for upward motion, a second output indicative of a demand for downward motion, and additional outputs each indicative of a different and unique preset speed;

a solid-state drive having as control inputs an enable signal line, a forward signal line, a reverse signal line, three speed switch signal lines, a field enable signal line and an acceleration-deceleration curve selection signal line; and a means for converting said outputs to said inputs, said converting means delaying said enabling input to prevent damage to said elevator hoist control system.

9. A retrofittable elevator controller/SSD interface and solid-state drive which is adapted for retrofitting an existing elevator control and a motor-generator set, and which replaces said motor-generator set without replacing said existing elevator control, comprising:

an interface for receiving control voltages from said existing elevator control, said interface comprising a relay bank switched by said existing elevator control, a sequencing means including a first enabling delay timer responsive to demand for motion from said elevator control, a second disabling delay timer responsive to said first enabling delay timer and producing as an output thereof an enabling and disabling signal subsequently coupled to said solid-state drive; and a speed logic converter for creating a composite speed signal from individual speed signals provided by said existing elevator control.

10. The retrofittable elevator controller/SSD interface and solid-state drive of claim 9, further comprising armature contactors closed responsive to said demand for motion and subsequently opened responsive to a third disabling delay timer timing out subsequent to said disabling output signal of said second disabling delay timer.

* * * * *